US007718724B2

(12) United States Patent
DeCristofaro et al.

(10) Patent No.: US 7,718,724 B2
(45) Date of Patent: May 18, 2010

(54) THERMOPLASTIC COMPOSITE MATERIALS FOR WEAR SURFACES AND METHODS FOR MAKING SAME

(75) Inventors: John L. DeCristofaro, Warren Township, NJ (US); Jason L. DeCristofaro, Warren Township, NJ (US); John Anthony Dispenza, Long Valley, NJ (US); Leon Klafter, Brielle, NJ (US); Richard Thomas LaGrotta, Livingston, NJ (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 238 days.

(21) Appl. No.: 11/717,977

(22) Filed: Mar. 14, 2007

(65) Prior Publication Data

US 2008/0226921 A1 Sep. 18, 2008

(51) Int. Cl.
*C08K 3/00* (2006.01)
*B32B 27/36* (2006.01)

(52) U.S. Cl. ..... 524/404; 428/412

(58) Field of Classification Search ..... 524/404
See application file for complete search history.

(56) References Cited

U.S. PATENT DOCUMENTS

| | | | | |
|---|---|---|---|---|
| 5,692,875 | A * | 12/1997 | Boman | 414/725 |
| 2002/0187292 | A1* | 12/2002 | Singler et al. | 428/36.91 |
| 2005/0023112 | A1 | 2/2005 | Karnes et al. | |
| 2006/0073004 | A1* | 4/2006 | Drexelius et al. | 414/719 |
| 2007/0155885 | A1* | 7/2007 | Bell et al. | 524/430 |

FOREIGN PATENT DOCUMENTS

| | | | |
|---|---|---|---|
| EP | 1431378 | A1 | 6/2004 |
| WO | WO93/14236 | A1 | 7/1993 |
| WO | WO2005/035642 | A1 | 4/2005 |

OTHER PUBLICATIONS

Wikipedia, The Free Encylopedia, Wear, Adhesive Wear, p. 1, http://en.wikipedia.org/w/index.php?title=Wear&printable=yes, Last visited Jan. 24, 2007.
Unknown Author, About Wear Strips, Plates and Parts, Global Spec, the Engineering Search Engine, p. 1, http://motion-controls.gobalspec.com/LearnMore/Motion_Controls/Linear_Rotary_Motion_Compon..., Last visited Jan. 24, 2007.
Wikipedia, The Free Encylopedia, Molybdenum disulfide, pp. 2, http://en.wikipedia.org/w/index.php?title=Molybdenum_disulfide&printable= yes, Last visited Jan. 3, 2007.
Wikipedia, The Free Encylopedia, Wear, p. 1 http://en.wikipedia.org/w/index.php?title=Wear&printable=yes, Last visited Jan. 24, 2007.
Zeus, Technical Whitepaper, Friction and Wear of Polymers, pp. 9, 2005.
Unknown Author, Wear Strips, Plates and Parts Engineering Web Results, p. 1 http://motion-controls.globalspec.com/LearnMore/Motion_Controls/Linear_Rotary_Motion_Compon..., Last visited Jan. 24, 2007.
Crown Plastics, The Leader in Manufacturing of Thin Gauge UHMW, pp. 2 http://www.crownplastics.com/UHMW.htm?snti=2-0, Last visited Jan. 10, 2007.
Delft Outlook, Rocking Rollers, pp. 9, http://www.delftoutlook.tudelft.nl/info/indexf4fa.html?hoofdstuk=Article&ArtID=5324, Last visited Jan. 10, 2007.
Whitford Worldwide, Wear, pp. 3, http://www.whitfordww.com/design/wear.html, Last visited Jan. 3, 2007.
Devcon Permatex, Protect Surfaces—Sliding Abrasion, p. 1, http://www.devcon.com/devconcatsoluton.cfm?catide=19, Last visited Feb. 1, 2007.
ITW Devcon, Part No. 0243, Wear Guard (High Load) Hardener, Material Safety Data Sheet, p. 1, Last revised Jan. 28, 2004, Danvers, MA, US.
ITW Devcon, Part No. 0112, Carbide Putty Resin, Material Safety Data Sheet, p. 1, Last revised Jun. 10, 2004, Danvers, MA, US.
ITW Devcon, Part No. 0200, Putty Hrdener 0200, Material Safety Data Sheet, p. 1, Last revised Nov. 15, 2001, Danvers, MA, US.
ITW Devcon, Part No. 0143, Wear Guard (High Load) Resin, Material Safety Data Sheet, p. 1, Last revised Dec. 6, 2001, Danvers, MA, US.
ITW Devcon, Part No. 0239, Wear Guard (Fine Load) Hardener, Material Safety Data Sheet, p. 1, Last revised Dec. 6, 2001, Danvers, MA, US.
Performance Ceramics Company, PCC Ceramic Powders, pp. 2, USA, http://www.performanceceramics.com/page4.htm, Last visited Jan. 3, 2007.
PCT Search Report, Search Report and Written Opinion, dated Jun. 13, 2008.

* cited by examiner

*Primary Examiner*—Ling-Sui Choi
*Assistant Examiner*—Hui Chin
(74) *Attorney, Agent, or Firm*—Fletcher Yoder PC

(57) ABSTRACT

The present techniques provide a method for making wear surfaces comprising a thermoplastic matrix blended with ceramic particles. The wear surfaces may optionally contain other materials, such as friction modifying additives. Wear surfaces formed according to these techniques may be used to protect such surfaces as the side rails of conveyor belts, the teeth of buckets used on front end loaders, rock or debris chutes, and self dumping hoppers, among others.

31 Claims, 2 Drawing Sheets

THERMOPLASTIC COMPOSITE MATERIALS FOR WEAR SURFACES AND METHODS FOR MAKING SAME

FIELD OF THE INVENTION

The present invention relates generally to the protection of machinery from wear. More particularly, the invention relates to the use of thermoplastic ceramic composite materials as wear surfaces.

DESCRIPTION OF THE RELATED ART

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Any surface that is in regular contact with another moving surface is subject to degradation over time, no matter how hard the surface may appear to be. For example, archeologically significant sites may have to be closed to tourist traffic to prevent erosion of the stonework from foot traffic. Degradation from wear is especially apparent in machinery and industrial applications where repetitive movements of one surface across another may cause significant erosion in a short time. A common example is the movement of a piston in a cylinder head in a car engine, which will wear out the engine over time. Even a very small apparent force, such as boxes sliding down a packaging chute, may eventually wear out the rails and surface of the chute. In larger applications, where the stresses are higher, wear may occur more quickly. For example, in mining applications, where heavy ore and rocks are being carried by a conveyor belt, the contact of these materials with the side rails of the conveyor belt may necessitate regular replacement of the rails.

It has been recognized since the late 1960s that there is a significant cost to industrial economies from problems caused by wear. Specific studies have indicated that the economy of the United States may lose several billions of dollars each year in replacement of materials and equipment that have been damaged, or "worn out," by frictional degradation.

Frictional degradation, or wear, may be defined as the process by which interactions of a surface with another surface result in a dimensional loss of the surfaces. The dimensional loss may or may not occur with an actual loss of material. The damaging interaction of the two surfaces is caused by the microscopic roughness of each surface. The high points of each surface are the actual points of contact with the other surface, and are termed "asperites." As one surface is moved across the other surface, the asperites may deform leading to resistance, or friction, in the movement. Further, as the asperites deform they may break off, causing degradation of the surface. Thus, to decrease wear, it is necessary to either harden the asperites to resist deformation or to decrease the interaction between the asperites of the opposing surfaces.

Hardening a surface may involve manufacturing the surface out of an exotic metal alloy. Examples of such alloys may include chromium steel and alloys of titanium, tungsten, or other hard metals. While these alloys may protect the hardened surface from degradation, a softer opposing surface may actually degrade at a faster rate. For this reason, hardening may often be confined to protecting parts which are harder to replace, such as ball bearings. Further, if the opposing surface is easier to replace, it may deliberately be made from a softer material to lower the wear on the hardened parts.

While effective, hardening a wear surface necessitates creating surfaces or parts out of expensive materials that are, by definition, hard and difficult to work with. For this reason, decreasing the interactions between the two surfaces may be a more economical option.

A primary technique for decreasing surface interactions involves lowering the coefficient of friction between two surfaces by the application of lubricating liquids. For example, the use of oil in car engines decreases friction between the surfaces of the pistons and the cylinders, leading to a longer life span for the engine. Without such lubricants, the engine may overheat or the moving parts may gall, i.e., one surface may lose metal to the other surface, leading to catastrophic failure of the engine. While liquid lubricants may commonly be used in machines having moving parts, such as engines or motors, they may not be practical for use with stationary parts across which other materials slide, such as chutes or side rails for conveyor belts.

For stationary parts, either hardening the surfaces or producing them from low friction materials may be the only practical choices. However, both of these choices may have significant drawbacks. For example, the use of exotic alloys as surface modifiers in low value applications, such as chutes, may be too expensive for many applications. Furthermore, surfaces made from low friction materials may not be durable enough for practical use.

Thermoset plastics may be used to provide more durable low friction coatings for applications in surface protection. However, thermoset plastics are often used in the form of a paste that is spread onto the surface to be protected, forming a permanent bond to the surface. This bonding may limit the reuse of the surface after further wear has occurred, which may force replacement of an entire part. Correct application of a thermoset paste may also require significant time and effort. Furthermore, if the application is performed on the manufacturing site, the equipment may need to be out of service for a significant period of time, further increasing the cost.

SUMMARY OF THE INVENTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

An embodiment of the present techniques provides a wear surface that comprises a blend of a thermoplastic matrix and one or more types of ceramic particles. The ceramic particles comprise at least 50% by volume of the blend.

Another embodiment provides a method for protecting a surface from wear. The method comprises blending one or more types of ceramic particles and a thermoplastic matrix. The ceramic particles comprise at least 50% by volume of the blend. A protective surface is formed from the blend.

Another embodiment provides a conveyer belt having a motor driven belt and side rails on each side of the belt. The side rails comprise a blend of one or more types of ceramic particles and a thermoplastic matrix. The ceramic particles comprise at least 50% by volume of the blend.

Another embodiment provides a front end loader comprising a loader bucket. The loader bucket comprises a blend of one or more types of ceramic particles and a thermoplastic matrix. The ceramic particles comprise at least 50% by volume of the blend.

Another embodiment provides a chute for directing gravity propelled objects to a destination. The chute is comprised of a blend of one or more types of ceramic particles and a thermoplastic matrix. The ceramic particles comprise at least 50% by volume of the blend.

Yet another embodiment provides a self-dumping hopper comprised of a blend of one or more types of ceramic particles and a thermoplastic matrix. The ceramic particles comprise at least 50% by volume of the blend.

BRIEF DESCRIPTION OF THE DRAWINGS

Advantages of the invention may become apparent upon reading the following detailed description and upon reference to the drawings in which.

DETAILED DESCRIPTION OF SPECIFIC EMBODIMENTS

One or more specific embodiments of the present invention will be described below. In an effort to provide a concise description of these embodiments, not all features of an actual implementation are described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The techniques described in detail below include thermoplastic ceramic composites which may be used for the protection of wear surfaces. These thermoplastic ceramic composites may be made from a blend of a thermoplastic matrix and hard ceramic particles. Optionally, the matrix may also contain friction modifying additives to lower the coefficient of friction of the surface. During wear, the hard ceramic particles embedded in the matrix are exposed, which may protect the thermoplastic matrix and slow further wear. These thermoplastic composites may be formed into any number of protective surfaces for specific applications. The parts made from thermoplastic composite materials may be manufactured off-site and purchased as preformed units for specific applications. Further, thermoplastic materials may be melted and reformed, which may be advantageous for resurfacing or recycling of a wear surface.

Figure 1:
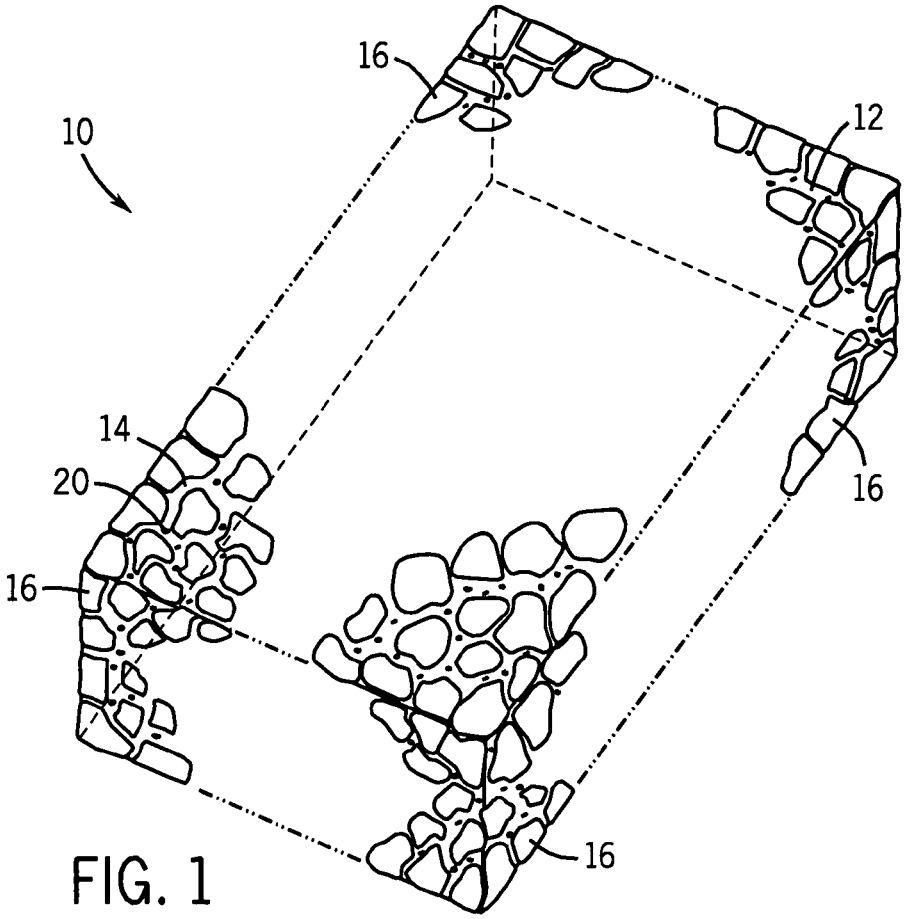
FIG. 1 is a perspective view of an exemplary thermoplastic ceramic composite in accordance with embodiments of the current techniques.

An example of a thermoplastic ceramic composite 10 that may be used for improved resistance to wear, in accordance with embodiments of the current techniques, is shown in FIG. 1. In this perspective view of the thermoplastic ceramic composite 10, the top surface may be used as the wear surface 12. The thermoplastic ceramic composite 10 may be made from a thermoplastic matrix 14 which has embedded ceramic particles 16. The ceramic particles 16 may be a mixture of different sizes and compositions. Further, the thermoplastic ceramic composite 10 may contain friction modifying additives 20 to decrease the coefficient of friction between the thermoplastic ceramic composite 10 and objects that slide across the wear surface 12.

The thermoplastic matrix 14 used to form the thermoplastic ceramic composite 10 may be selected on the basis of the desired surface friction, hardness, or resistance to wear. Thermoplastics that may be used for the thermoplastic matrix 14 include polyolefins, polycarbonates, poly(phenylene sulfides), poly(phenylene oxides), poly(ether ether ketones), polyamides, or combinations thereof. The choice of materials depends on the combination of properties desired. For example, a polyolefin material may have a lower coefficient of friction than a poly(phenylene sulfide), but may also have a lower resistance to damage from heavy objects. Another parameter that may influence the choice of the thermoplastic matrix 14 is the resistance of the matrix to degradation from heat that may be generated by objects sliding across the surface. Accordingly, in applications where heat may be generated, heat resistant thermoplastics such as poly(phenylene sulfide) or poly (ether ether ketone) may be more appropriate than other thermoplastics.

Although the choice of the material for the thermoplastic matrix 14 is an important consideration, the ceramic particles 16 will be the primary component of the wear surface 12 that is in contact with another surface. Thus, the amount and type of ceramic particles 16 in the thermoplastic ceramic composite 10 may significantly affect the properties and life span of the wear surface 12. In embodiments of the present techniques, the ceramic particles 16 may make up as much as 50% of the total composition by volume. In other embodiments, the ceramic particles 16 may make up at much as 90% by volume of the total composition of the thermoplastic ceramic composite 10.

The ceramic particles 16 may be made from alumina, boron carbide, boron nitride, silicon carbide, silicon nitride, magnesium silicate, magnesium oxide, titanium carbide, titanium oxide, tungsten carbide, zirconia, or combinations of these materials. As the thermoplastic ceramic composite 10 is intended to be low cost and easily replaceable, lower cost ceramic materials may be appropriate. Further, the ceramic particles 16 may be comprised of newly manufactured particles or waste particles, such as used alumina sand blasting dust.

The size of the ceramic particles 16 may range from greater than 50 micrometers to less than 1 millimeter. A wide particle size distribution may improve the wear performance of the panel. For example, while larger particles may be less likely to abrade from the matrix, and, thus, more effective at preventing wear, smaller particles may improve the packing efficiency in the matrix. Improved packing of the ceramic particles 16 may lead to a higher concentration of ceramic particles 16 in the thermoplastic matrix 14. This may increase the number of particles that an opposing surface contacts, which may increase the wear protection of the thermoplastic ceramic composite 10.

The shape of the ceramic particles 16 may also affect the frictional performance of the thermoplastic ceramic composite 10. For example, it may be appropriate to select ceramic particles 16 that are spherical or rod shaped in order to minimize the roughness of the surface of the ceramic particles 16.

Alternatively, the ceramic particles 16 may be flat. These flat particles could be aligned with each other and the wear surface 12 by shear forces during the molding process. The alignment of such flat particles may increase the surface area of ceramic at the wear surface 12, which may increase the wear resistance of the thermoplastic ceramic composite 10.

The ceramic particles 16 may include nanospherical particles, e.g., particles having diameters on the order of 50 to 500 nanometers. These very small particles may decrease the microscopic surface roughness of the thermoplastic ceramic composite 10, which may decrease the overall friction seen as another surface moves across the thermoplastic ceramic composite 10. Further, as the very tiny spherical ceramic particles 16 are worn out of the surface and detach from the thermoplastic matrix, they may act as friction modifying additives 20, as discussed in detail below.

The thermoplastic ceramic composite 10 may contain friction modifying additives 20 to lower the frictional interaction between the wear surface 12 and an opposing surface. Without intending to be limiting, such a decrease in the surface friction may be caused by various interactions between the friction modifying additive 20 and the wear surface 12. For example, the nanospherical particles described above may function as tiny ball bearings, allowing the surfaces to roll across one another. Other friction modifying additives 20 may tend to fill in the surface roughness, lowering the number of asperites available to engage asperites on an opposing surface. Still other additives may lower the adhesion between the surfaces, allowing the surfaces to slide over each other more easily. Examples of materials that may be used as friction modifying additives 20 include graphite, boron powder, calcium carbonate, ground sea shells, talc, rock dust, poly (tetrafluoroethylene) powder, molybdenum sulfide, tungsten sulfide, or combinations of these materials.

The nature and value of the opposing surface may also dictate the choice of the friction modifying additive 20. For example, if the thermoplastic ceramic composite 10 is intended for use in an application wherein rock or other heavy ores are coming in contact with the wear surface 12, a lower cost additive may be appropriate. Alternatively, where a high value surface may contact the thermoplastic ceramic composite 10, a higher cost friction modifying additive 20 may be chosen to protect the opposing surface. This situation may arise, for example, when a chute in a manufacturing facility is used for transporting easily scratched packages.

Example of Thermoplastic Ceramic Composite Wear Surface

An embodiment of a thermoplastic ceramic composite 10 made in accordance with the procedures described above was tested for resistance to wear. In this embodiment, a polycarbonate, Lexan® EXL 9330 high impact grade from General Electric, was used as the thermoplastic matrix 14. Approximately 50% by volume of ceramic particles 16 made from randomly sized alumina fragments were blended into this matrix. A comparison sample made from an epoxy matrix containing approximately 50% by volume of randomly sized alumina fragments was also tested. For both samples, the alumina fragments had a mesh up to size six, which corresponds to a wide distribution of particle sizes with a maximum size of approximate 0.45 mm. The samples contained no friction modifying additives 20.

The testing was performed using a dry sand rubber wheel test, ASTM number G65. In this test, a sample is placed in a frame that pushes the wear surface 12 against a rotating rubber wheel at a constant force. Dry sand is poured from a hopper in between the wear surface 12 and the rubber wheel and is effectively ground into the surface. The dry sand test is usually run for a single time period of 6,000 revolutions. Measurements of the mass of the sample are taken before and after the test, and the density of the material is used to calculate the volume of the sample that is abraded during the test. Conversion of the material loss from mass to volume compensates for different densities, allowing different materials to be compared.

The test procedure described above was modified to minimize the heat exposure by stopping the run after every 1000 revolutions and weighing the samples. Heating of the samples may have distorted the results by melting the polycarbonate matrix, allowing alumina grains to be extracted from the melt. The results obtained from the tests are shown in Table 1.

TABLE 1

WEAR SURFACE TEST OF THERMOPLASTIC CERAMIC COMPOSITE

| Matrix Material | No. of Revolutions | Change in Mass (g) | Est. Change in Vol. (ml) |
|---|---|---|---|
| Polycarbonate | 1000 | 0.168 | 0.051 |
| | 2000 | 0.005 | 0.002 |
| Epoxy | 1000 | 0.239 | 0.072 |
| | 2000 | 0.048 | 0.014 |
| | 3000 | 0.035 | 0.011 |
| | 4000 | 0.017 | 0.005 |
| | 5000 | 0.014 | 0.004 |

The estimated change in volume was calculated on the basis of a composition containing 50% alumina by volume. A density of 3.97 g/ml was used for the alumina, and densities of 1.3 g/ml and 1.2 g/ml were used for the polycarbonate and epoxy, respectively. The testing was stopped after the measured mass dropped below the accurate limits of measurement, around 0.005 g. Accordingly, only two cycles of testing (2000 revolutions) were run on the wear surface 12 having a thermoplastic matrix 14 made from polycarbonate before it dropped below the accurate limits of measurement. In contrast, the epoxy based composite continued to lose a measurable amount of material throughout the test sequence.

Applications of Thermoplastic Ceramic Composites

The thermoplastic ceramic composites 10 of the present techniques may be used in any number of applications for improvement of wear resistance. Examples of such applications are shown in FIGS. 2-4, which illustrate a conveyor belt, a front end loader, a rock or debris chute, and a self dumping hopper.

Figure 2:
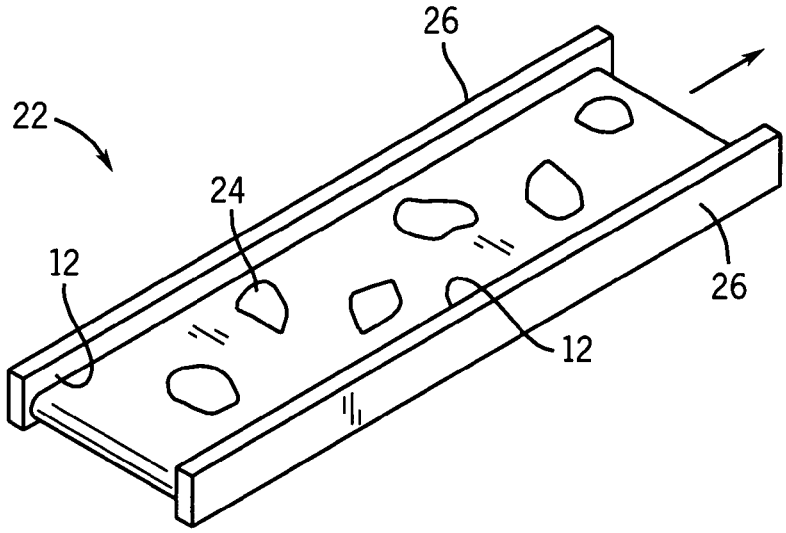
FIG. 2 is a perspective view of a conveyor belt that may use thermoplastic ceramic composites for protection of wear surfaces in accordance with embodiments of the current techniques.

As shown in FIG. 2, a conveyor belt 22 may be used to carry rock fragments 24 in a mining operation. The contact of the rock fragments 24 with the side rails 26 of the conveyor belt 22 may lead to significant wear in a short period of time, necessitating frequent replacement. In embodiments of the present techniques, thermoplastic ceramic composites 10 may be used as wear surfaces 12 to protect the side rails 26. In one embodiment, the side rails 26 may be made from the thermoplastic ceramic composite 10. In another embodiment, the side rails 24 may be metal, with thin panels of the thermoplastic ceramic composites 10 attached to protect the side rails 26.

Figure 3:
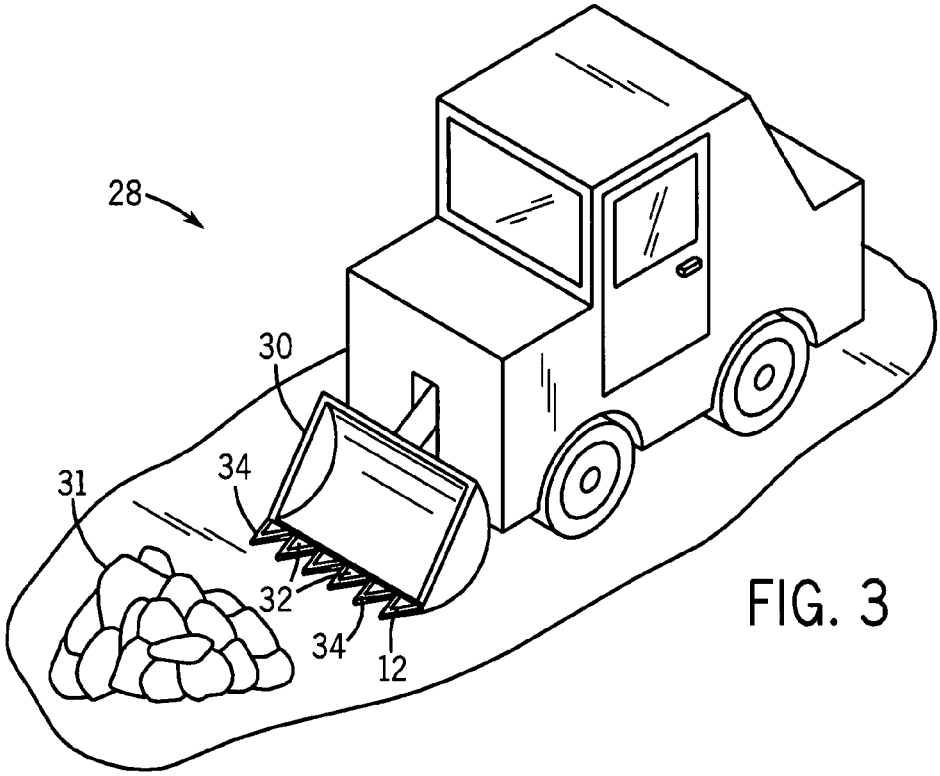
FIG. 3 is a perspective view of a front end loader having a blade and teeth that may be protected by thermoplastic ceramic composites in accordance with embodiments of the present techniques.

Another application is shown in FIG. 3, which is a perspective view of a front end loader 28, with a loader bucket 30. The loader bucket 30 is subject to significant wear, especially in heavy service applications such as loading rocks and ores 31. The metal teeth 32 of the loader bucket 30 are a primary site for wear, and must be regularly replaced or resurfaced. In an embodiment of the present techniques, replaceable sheaths 34 made from a thermoplastic ceramic composite 10 may be used to cover the wear surfaces 12 of the metal teeth 32. In another embodiment, the thermoplastic ceramic composite 10 may be formed into teeth that are used in place of the metal teeth 32. Such thermoplastic ceramic composite 10 parts may be easily detached and replaced, minimizing downtime.

Figure 4:
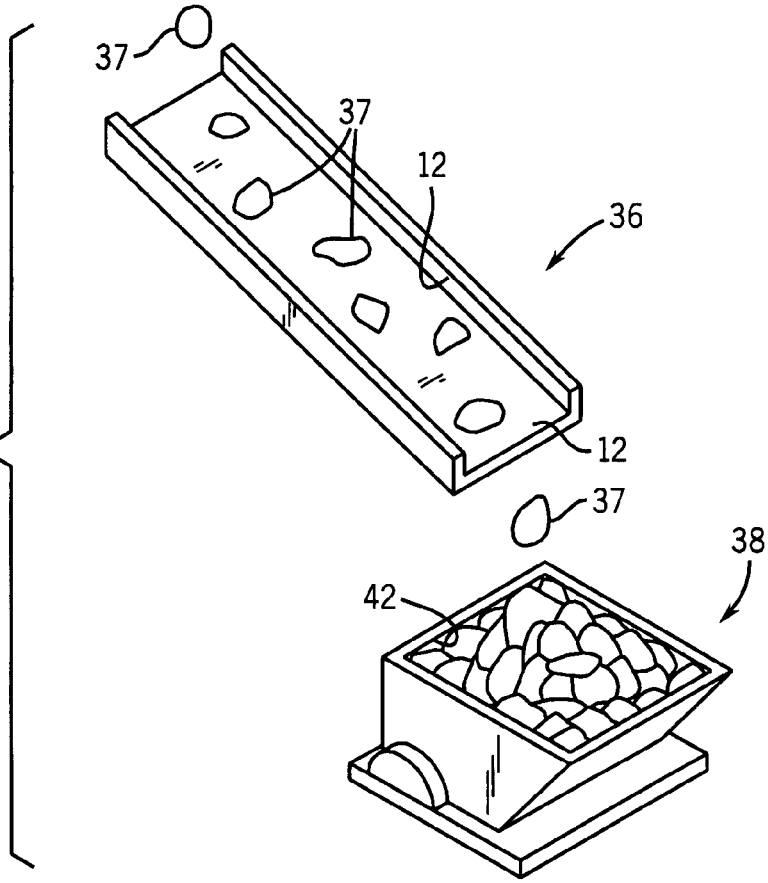
FIG. 4 is a perspective view of a rock or debris chute directing materials into a loader bucket, in which surface of each may be protected by thermoplastic ceramic composites in accordance with embodiments of the present techniques.

In FIG. 4, a chute 36 is used to direct materials 37 into a self-dumping hopper 38. This arrangement may be used, for example, for loading ore in a mining operation or loading construction debris during a demolition operation. The material 37 impacting and sliding along the wear surfaces 12 of the chute 36 and the interior surface 42 of the self-dumping hopper 38 may cause heavy wear, necessitating frequent repair or replacement of the units. In an embodiment of the present techniques, the chute 36 may have panels made from a thermoplastic ceramic composite 10 mounted to the interior wear surfaces 12, protecting these surfaces from damage. Such thermoplastic ceramic composite 10 panels may be easily detached and replaced, minimizing downtime. In another embodiment, the entire chute 36 may be made from thermoplastic ceramic composites 10, which may have both a longer lifespan and a lower cost than a metal chute. Similarly, the self dumping hopper 38 may have panels of the thermoplastic ceramic composite 10 attached to protect the interior surface 42. Alternatively, the self dumping hopper 38 may be made from the thermoplastic ceramic composite 10.

It should be understood that the present techniques have been described above by way of example and that such techniques may apply in other situations as well. Indeed, numerous other applications may take advantage of the enhanced wear, low cost, and recyclability of the thermoplastic ceramic composites 10 discussed above. Examples of such applications may include dumpsters, rolling surfaces for bearings, door jambs, entry mats for buildings, and protective mats for high traffic areas of archeologically valuable tourist attractions, among others.

While the invention may be susceptible to various modifications and alternative forms, specific embodiments have been shown by way of example in the drawings and/or described in detail herein. However, it should be understood that the invention is not intended to be limited to the particular forms disclosed. Rather, the invention is to cover all modifications, equivalents, and alternatives falling within the spirit and scope of the invention as defined by the following appended claims.

We claim:

1. A wear surface of one layer comprising a blend of a thermoplastic matrix and one or more types of ceramic particles, wherein the ceramic particles comprise at least 50% by volume of the blend.

2. The wear surface, as set forth in claim 1, wherein the thermoplastic matrix comprises at least one of a polyolefin, a polycarbonate, a poly(phenylene sulfide), a poly(phenylene oxide), a poly(ether ether ketone), a polyamide, or combinations thereof.

3. The wear surface, as set forth in claim 1, wherein the ceramic particles comprise at least one of alumina, boron carbide, boron nitride, silicon carbide, silicon nitride, magnesium silicate, magnesium oxide, titanium carbide, titanium oxide, tungsten carbide, zirconia, or combinations thereof.

4. The wear surface, as set forth in claim 1, wherein the ceramic particles comprise at least 80% by volume of the blend.

5. The wear surface, as set forth in claim 1, wherein the ceramic particles comprise at least one of random shaped particles, substantially spherical particles, substantially rod shaped particles, substantially flat particles, or combinations thereof.

6. The wear surface, as set forth in claim 1, wherein the ceramic particles comprise substantially flat particles that are aligned substantially parallel to a surface of the structure.

7. The wear surface, as set forth in claim 1, wherein the ceramic particles comprise substantially spherical particles having a diameter greater than about 50 nm and less than about 500 nm.

8. The wear surface, as set forth in claim 1, wherein the ceramic particles comprise a substantially even distribution of sizes from greater than about 0.050 mm to less than about 1 mm.

9. The wear surface, as set forth in claim 1, comprising a protective covering for at least one of a side rail for a conveyor belt, a chute, a debris chute, a rock chute, a bearing surface, a loader bucket, a tooth of a loader bucket, a self dumping hopper, or a dumpster.

10. The wear surface, as set forth in claim 1, comprising at least one of a side rail for a conveyor belt, a chute, a debris chute, a rock chute, a bearing surface, a loader bucket, a tooth of a loader bucket, a self dumping hopper, or a dumpster.

11. The wear surface, as set forth in claim 1, comprising a friction reducing additive.

12. The wear surface, as set forth in claim 11, wherein the friction reducing additive comprises at least one of graphite, poly(tetrafluoroethylene) powder, molybdenum sulfide, tungsten sulfide, boron powder, calcium carbonate, ground seashells, talc, rock dust, or combinations thereof.

13. A method for protecting a surface from wear, comprising blending of one or more types of ceramic particles and a thermoplastic matrix, wherein the ceramic particles comprise at least 50% by volume of the blend; and forming a protective surface from the blend.

14. The method, as set forth in claim 13, wherein the thermoplastic matrix comprises at least one of a polyolefin, a polycarbonate, a poly(phenylene sulfide), a poly(phenylene oxide), a poly(ether ether ketone), a polyamide, or combinations thereof.

15. The method, as set forth in claim 13, wherein the ceramic particles comprise at least one of alumina, boron carbide, boron nitride, silicon carbide, silicon nitride, magnesium silicate, magnesium oxide, titanium carbide, titanium oxide, tungsten carbide, zirconia, or combinations thereof.

16. The method, as set forth in claim 13, wherein the ceramic particles comprise at least 80% by volume of the blend.

17. The method, as set forth in claim 13, wherein the protective surface comprises at least one of a side rail for a conveyor belt, a chute, a debris chute, a rock chute, a bearing surface, a loader bucket, a tooth of a loader bucket, a self dumping hopper, or a dumpster.

18. The method, as set forth in claim 13, wherein the protective surface comprises a protective covering for at least one of a side rail for a conveyor belt, a chute, a debris chute, a rock chute, a bearing surface, a loader bucket, a tooth of a loader bucket, a self dumping hopper, or a dumpster.

19. A conveyer belt comprising a motor driven belt; and side rails on each side of the belt, wherein the side rails comprise a blend of one or more types of ceramic particles and a thermoplastic matrix, and wherein the ceramic particles comprise at least 50% by volume of the blend.

20. The conveyor belt, as set forth in claim 19, wherein the side rails are made from the blend.

21. The conveyor belt, as set forth in claim 19, wherein the side rails have attached panels comprising the blend.

22. A front end loader comprising a loader bucket, wherein the loader bucket comprises a blend of one or more types of ceramic particles and a thermoplastic matrix, and wherein the ceramic particles comprise at least 50% by volume of the blend.

23. The front end loader, as set forth in claim 22, wherein the loader bucket comprises teeth made from the blend.

24. The front end loader, as set forth in claim 22, wherein the loader bucket comprises teeth having attached covers comprising the blend.

25. A chute for directing gravity propelled objects to a destination comprising a blend of one or more types of ceramic particles and a thermoplastic matrix, and wherein the ceramic particles comprise at least 50% by volume of the blend.

26. The chute, as set forth in claim 25, comprising attached panels made from the blend.

27. The chute, as set forth in claim 25, wherein the chute is molded from the blend.

28. The chute, as set forth in claim 25, comprising either a rock chute or a debris chute.

29. A self-dumping hopper comprising a blend of one or more types of ceramic particles and a thermoplastic matrix, and wherein the ceramic particles comprise at least 50% by volume of the blend.

30. The self-dumping hopper, as set forth in claim 29, comprising attached panels made from the blend.

31. The self-dumping hopper, as set forth in claim 29, comprising a hopper bucket made from the blend.

* * * * *